United States Patent [19]

Winter et al.

[11] 4,397,160

[45] Aug. 9, 1983

[54] NEEDLE ARRANGEMENT FOR WARP KNITTING MACHINES AND WARP KNITTING MACHINES EQUIPPED THEREWITH

[75] Inventors: Karl Winter, Obertshausen; Gerhard Hittel, Rodgau, both of Fed. Rep. of Germany

[73] Assignee: Karl Mayer Textilmaschinenfabrik GmbH, Obertshausen, Fed. Rep. of Germany

[21] Appl. No.: 305,261

[22] Filed: Sep. 24, 1981

[30] Foreign Application Priority Data

Sep. 26, 1980 [DE] Fed. Rep. of Germany ..... 3036309

[51] Int. Cl.[3] ..... D04B 35/04

[52] U.S. Cl. ..... 66/120; 66/208

[58] Field of Search ..... 66/116, 120, 121, 208, 66/203

[56] References Cited

U.S. PATENT DOCUMENTS

Re. 30,931 5/1982 Winter ..... 66/120

2,522,335 9/1950 Amidon ..... 66/120 X

FOREIGN PATENT DOCUMENTS 637438 3/1962 Italy ..... 66/120

*Primary Examiner*—Ronald Feldbaum

*Attorney, Agent, or Firm*—Omri M. Behr

[57] ABSTRACT

A knitting needle set for a warp knitting machine has a needle bar and a plurality of hooked needles each of substantially equal length clamped to the needle bar. The plurality of needles each have a hook end and each have at substantially the same distance from its clamping position an insertion opening bordered by the hook end. This insertion opening leads to an interior hook space. The plurality of needles are divisible into at least two groups. The spacing from the zenith of the concave surface of the hook space to the hook end in each of the needles of a given one of the groups differs from that of another one of said groups.

10 Claims, 6 Drawing Figures

Fig.5
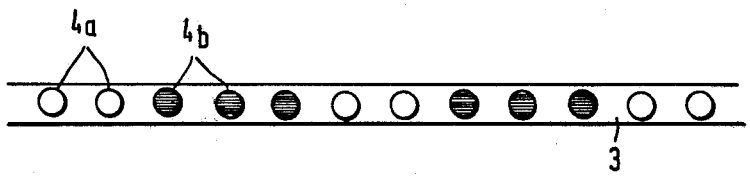
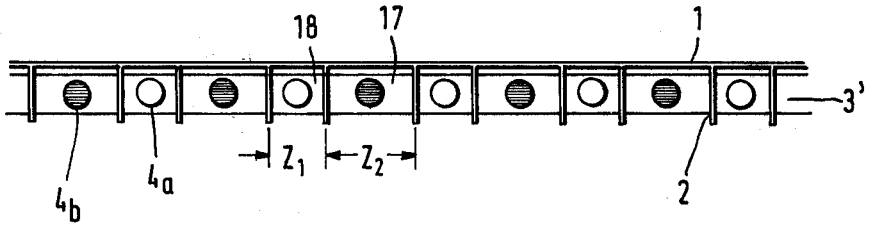
Fig.6

NEEDLE ARRANGEMENT FOR WARP KNITTING MACHINES AND WARP KNITTING MACHINES EQUIPPED THEREWITH

BACKGROUND OF THE INVENTION

1. Field of the Invention

The present invention relates to needle arrangements for a warp knitting machine and, in particular, to arrangements having needles all of the same length and wherein the ends of the hooks surrounding the insertion opening to the hook space of the various needles have the same separation from the clamping position of the needle.

2. Discussion of the Relevant Art

Needle arrangements of the foregoing type are common in conventional warp knitting machines. These arrangements comprise a plurality of similar needles which produce, during their use, a fabric having a plurality of similar stitches.

A known warp knitting machine (DEOS No. 2843264) has two needle bars comprising mutually similar needles which together comprise a needle bed. While the two bars are driven at the same time and in the same manner, these have different strokes which produce a substantially similar inlay dead point and different knockover position dead point. In this way, it is possible to produce fabric with stitches of different sizes. However in order to do this, it is necessary to provide two needle bars with the appropriate guiding means.

Thus, there is a need for a simple and efficient technique for providing differently sized stitches with standard thread laying equipment and, if desired, a single needle bar.

SUMMARY OF THE INVENTION

Therefore, it is one object of the present invention to provide a means for producing goods having stitches of different sizes.

It is another object of the present invention to provide at least two groups of different needles arranged to produce differently sized stitches.

A knitting needle set for a warp knitting machine according to the principles of the present invention has a needle bar and a plurality of hooked needles each of substantially equal length and each separately clamped to said needle bar at a different clamping position. The plurality of needles each have a hook end and each have at substantially the same distance from its clamping position, an insertion opening bordered by the hook end. This insertion opening leads to an interior hook space. The plurality of needles are divisible into at least two groups. The spacing from the zenith of the concave surface of the hook space to the hook end in each of the needles of a given one of the groups differs from that of another one of the groups.

By employing such equipment, the needles can be attached to a single needle bar and still produce stitches of different sizes. This can be accomplished with hooks having substantially similar external appearance but possessing in part, a shortened hook space. To this end, there are provided at least two groups of needles having a different distance between the hook end and the concave surface of the hook space.

BRIEF DESCRIPTION OF THE DRAWINGS

In order that the invention may be more fully understood, it will now be described, by way of example, with reference of the accompanying drawings in which:

FIG. 5 is a schematic, plan view of the needles of FIGS. 1 and 2; and FIG. 6 is an arrangement of needles which is an alternate to that of FIG. 5 and which also shows a trick plate.

DESCRIPTION OF THE PREFERRED EMBODIMENT

Figure 1:
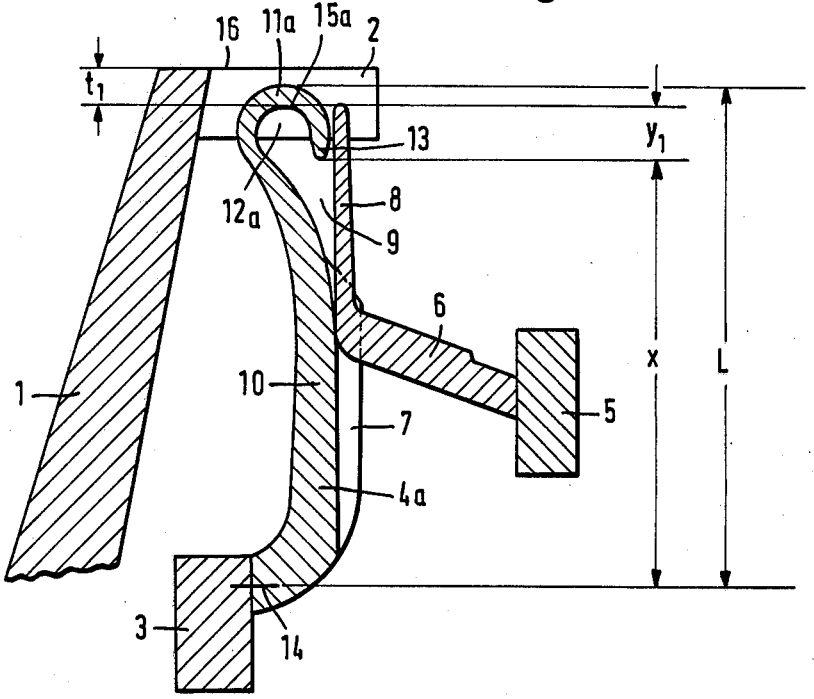
FIG. 1 is an elevational, cross-sectional view of a knockover bar and one type of needle of a needle set in the knockover position in a first embodiment of the present invention.
Figure 2:
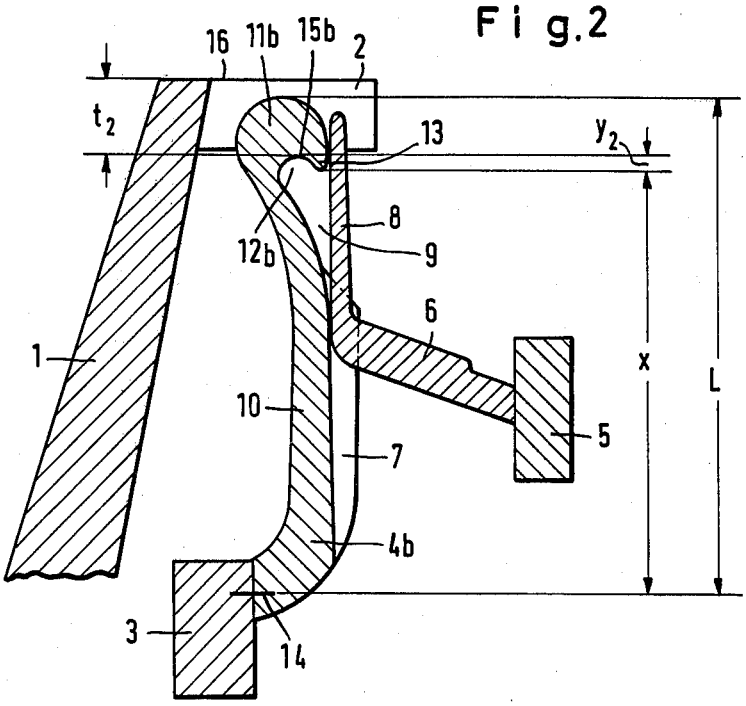
FIG. 2 is an elevational, cross-sectional view of the apparatus of FIG. 2 but through a different type of needle of the needle set.

In the embodiment of FIGS. 1 and 2, a continuous knockover bar 1 is provided with trick plates 2 which operate as the knockover means. Bar 1 is mounted to perform vertical reciprocation in a timed relation with the other equipment in FIGS. 1 and 2. Bar 1 is an elongate plate and trick plates 2, in this embodiment, spaced members which are interleaved between plurality of hooked needles 10.

Needles 10 comprise a given group of needles **4*b* (FIG. 2) and another group of needles 4*a* (FIG. 1) all suitably clamped in a spaced, parallel relation on continuous needle bar 3. The sequencing of needles 4*a* and 4*b* along bar 3** is described hereinafter.

Mounted on continuous slider bar 5 are a plurality of similar, parallel, spaced sliders 6. Extending obliquely from the main body of sliders 6 are closing portions 8 which move parallel to needles 10 within their grooves 7. Closing portions 8 move relative to needles 10 to open and close the insertion (inlay) opening 9 leading to hook space **12*a* and 12*b*. Both needles 4*a* and 4*b* have the same shaft length L but different hooks 11*a* and 11*b* and different hook spaces 12*a* and 12*b*. Yet in both, hook end 13, which terminates the insertion opening 9, is the same distance X from the point 14 where the hook is clamped into needle bar 3. There is, however, a difference in the distance between this hook end 13 and the zenith 15*a* or 15*b* of the concave hook space 12*a* or 12*b*, respectively: in needle 4*a* this distance is Y1 and in needle 4*b* it is a smaller distance Y2. Since both needles have the same length L, it follows that needle 4*b* has a thicker upper hook portion 11*b* above zenith 15*b* than needle 4*a* at portion 11*a* above zenith 15*a***.

The bars 3 and 5 are driven in conventional manners so that at the upper dead point of needles **4*a* and 4*b*, insertion openings 9 open. The insertion openings 9 and hook ends 13 are aligned so that threads can be layed into needles 4*a* and 4*b* by the guides (not shown) in the same way and at the same height. In the lower dead point position as illustrated in FIGS. 1 and 2, there is a lesser knockover depth t1 between zenith 15*a* and knockover edge 16 (FIG. 1) than there is between zenith 15***b* and knockover edge 16 (FIG. 2), the second distance being designated t2. This in turn leads to the desired differences of stitch size.

Figure 3:
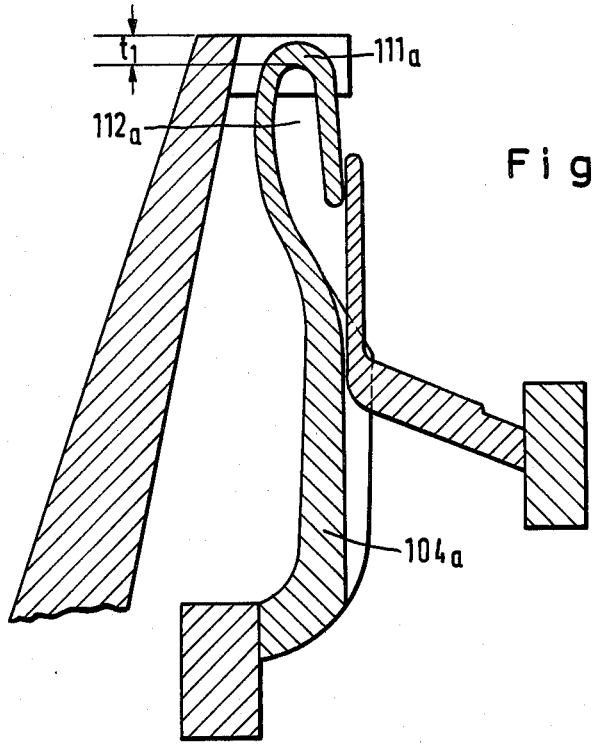
FIG. 3 is an elevational, cross-sectional view of a knockover bar and one type of needle of a needle set in the knockover position in a second embodiment of the present invention.
Figure 4:
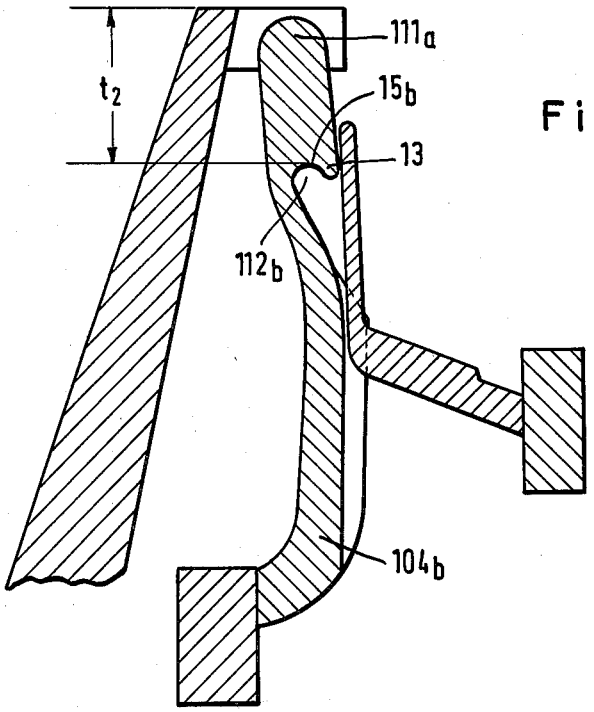
FIG. 4 is an elevational, cross-sectional view of the apparatus of FIG. 3 but through a different type of needle of the needle set.

In the alternate embodiment illustrated in FIGS. 3 and 4, the only parts designated with numbers are those which have been changed from FIGS. 1 and 2. In this embodiment, the needle 104*a* is provided with a relatively long hook 111*a* which encloses a substantially long hook space 112*a*. In F 7. 4 there is shown a needle 104*b* of another group, whose hook 111*b* only encloses a rather small hook space 112*b*. In consequence thereof, in needle 104*a* there is a rather small knockover depth t1, while needle 104*b* has a rather large knockover depth t2. Otherwise, the movements achievable by the components in FIGS. 3 and 4 are the same as previously described. Furthermore, the needles 104*a* and 104*b* move together so that at their upper (inlay) dead point, their insertion openings are aligned at the same level so thread (not shown) can be inlayed identically for both types of needles.

An advantage of the foregoing, as explained further hereinafter, is that since one group comprises long hooked needles 104 and since in the other group, the concave portion 15*b* of the hook space 112*b* is located nearer the hook end 13, this leads to very great differentiation in the knockover depth and corresponding differences in the stitch size.

FIG. 5 is a schematic representation of the needle bar of FIGS. 1 and 2 with needles 4*a* and 4*b* shown thereon. The needles are shown evenly spaced along bar 3. This illustrated sequence has two needles 4*a* adjacent three needles 4*b* to form a five needle pattern that repeats along the length of bar 3. It will be appreciated that this exemplary pattern can be altered in other embodiments.

In the alternate embodiment of FIG. 6, there is a needle bar 3' provided with needles 4*a* and 4*b* placed individually and alternately. Also the previously illustrated trick plates 2 are shown to have different separations. Specifically, at needles 4*a* there is a small separation Z1 and at needles 4*b* a larger separation Z2. In this manner, relatively large passage 17 is provided for larger stitches (which require more space) than passage 18 for the smaller stitches.

In operation, needles 4*a* and 4*b* reciprocate in a conventional manner with respect to trick plates 2. It will be assumed that, at this time, previously knitted loops (not shown) are encircling needles 4*a* and 4*b* as well as their closing portions 8. Initially, needles 4*a* and 4*b* rise above trick plates 2 while sliders 6 translate in a direction toward needle bar 3, thereby opening insertion opening 9. The usual overlapping of thread into hook space 12*a* and 12*b* can now occur followed by a closing of insertion opening 9 by closing portion 8, in a conventional fashion. Therefore, these recently inlayed threads are now held within hook spaces 12*a* and 12*b* above the previously knitted loops. In this inlay position, which is one of the dead points of the movement stroke, the threads were layed into the hook spaces 12*a* and 12*b* of all needles 4*a* and 4*b* in exactly the same way. Thus, conventional thread laying equipment (not shown) can be used.

Needles 4*a* and 4*b* together with their sliders 6 now move relative to trick plates 2, eventually reaching the position shown in FIGS. 1 and 2, at which time knockover has occurred. In this knockover position, the lower dead point of the stroke, the zenith 15*a* of the hook surface of the needles 4*a* has a different separation from the knockover edge 16 of trick plate 2, than that of needles 4*b* of the other group. In particular, dimension t2 of needles 4*b*, exceeds dimension t1 of needles 4*a*. As a consequence of this different knockover depth, the series of stitches produced by needles 4*b* will be larger than those of needles 4*a*, as desired. Production of these larger stitches is facilitated by the additional room existing between adjacent plates 2 surrounding needles 4*b* (FIG. 6). Accordingly, this larger spacing Z2 accommodates larger stitches than would be handled in spacing Z1.

The operation of needles 104*a* and 104*b* of FIGS. 3 and 4 is similar, except that the distance t2 is significantly greater than the corresponding dimension of FIG. 2. Needles 104*b* therefore produce much larger stitches. However, in all other respects, needles 104*a* and 104*b*, their sliders and knockover sinkers, reciprocate in a fashion similar to that previously described.

Hereinbefore has been disclosed an efficient device for producing differently sized stitches with two groups of hooked needles. Through the arrangement of different needles along the needle bar there is provided a first patterning arrangement. During the knitting process itself, however, other known patterning effects may be employed. For example, by the influencing of the guide bars by means of pattern chains. Also, the needle bar provided in such warp knitting machines employing the above described needle arrangement, can have the needles of different groups follow each other singly or in groups of various numbers along the needle bar. Furthermore, in place of the illustrated slider (compound) needles, other needles for example, latch needles may also be employed. This disclosed arrangement can also be used in double bedded warp knitting machines in which each of the needle beds are provided upon separate needle bars which are equipped with different groups of needles. As an example of other possible variations, needles 4*b* and 104*b* can have a smaller length in which case hooks 11*b* and 111*b* are correspondingly reduced in thickness.

It will be understood that various changes in the details, materials, arrangement of parts and operating conditions which have been herein described and illustrated in order to explain the nature of the invention may be made by those skilled in the art within the principles and scope of the instant invention.

Having thus set forth the nature of the invention, what is claimed is:

1. A knitting needle set for a warp knitting machine comprising:

(a) a needle bar; and (b) a plurality of hooked needles each of substantially equal length clamped to said needle bar, said plurality of needles each having a hook end and each having at substantially the same distance from its clamping position an insertion opening bordered by the hook end, said insertion opening leading to an interior hook space, said plurality of needles being divisible into at least two groups, the spacing from the zenith of the concave surface of the hook space to the hook end in each of the needles of a given one of said groups differing from that of another one of said groups.

2. A knitting needle set according to claim 1 wherein the zenith of the concave surface of the hook space is closer to the hook end for the needles in said given one of said groups than for the needles in another one of said groups.

3. A knitting needle set according to claim 2 wherein at least one of the needles from each of said groups are arranged in a pattern that repeats along the length of said needle bar.

4. A knitting needle set according to claim 2 wherein said plurality of needles are arranged along said needle bar in a sequence wherein a given number of the needles from said given one of said groups alternate with a predetermined number of the needles from another one of said groups.

5. A knitting needle set according to claim 4 wherein said given number is at least two.

6. A knitting needle set according to claim 1 wherein each hook end of said plurality of needles is colinear.

7. A knitting needle set according to claim 6 wherein said needles comprise compound needles.

8. In a warp knitting machine according to claim 1 including said needle set, said warp knitting machine further comprising:

knockover means interleaved with said plurality of needles for reciprocating relative thereto, the zenith of the hook space of each of the needles of said given one of said groups being advanced with respect to another one of said groups upon said plurality of needles relatively moving in a direction tending to disengage them from said knockover means.

9. A knitting needle set according to claim 8 wherein said knockover means comprises:

a plurality of members embracing without touching said plurality of needles, said members being closer to the needles of one of said groups than to another.

10. A knitting needle set according to claim 8 wherein said members are more distant from the needles of said given one of said groups than to another.

* * * * *